United States Patent [19]

Kowal

[11] 4,403,496

[45] Sep. 13, 1983

[54] TUBE BENDER CONSTRUCTION

[75] Inventor: Leonard J. Kowal, Prospect Heights, Ill.

[73] Assignee: Imperial Clevite Inc., Rolling Meadows, Ill.

[21] Appl. No.: 229,861

[22] Filed: Jan. 30, 1981

[51] Int. Cl.[3] ..... B21D 11/04

[52] U.S. Cl. ..... 72/388

[58] Field of Search ..... 72/388, 459, 458, 457, 72/387, 217, 32, 33, 34, 35, 36, 149, 461; 81/415, 416, 417

[56] References Cited

U.S. PATENT DOCUMENTS

| | | | |
|---|---|---|---|
| 2,428,237 | 9/1947 | McIntosh | 72/388 |
| 2,464,800 | 3/1949 | Franck | 72/388 |
| 2,654,279 | 10/1953 | Tomarin | 72/388 |
| 2,757,562 | 8/1956 | Zales | 72/388 |
| 2,796,785 | 6/1957 | Philippe | 72/388 |
| 2,887,917 | 5/1959 | Kowal | 72/388 |
| 2,908,193 | 10/1959 | Gryniewicz | 72/388 |
| 3,194,038 | 7/1965 | Small | 72/319 |
| 3,380,283 | 4/1968 | Wilson | 72/319 |
| 3,447,353 | 6/1969 | Noveske | 72/217 |
| 3,750,447 | 8/1973 | Kowal | 72/388 |
| 3,789,640 | 2/1974 | Frank | 72/388 |
| 3,926,028 | 12/1975 | Kowal | 72/388 |

*Primary Examiner*—Gene Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by tube-holding structure arranged to clamp the tube against an extended groove portion of the mandrel. Movement of the forming member about the bending axis is effected by manipulation of a pair of handles which are arranged in offset manner to permit crossover of the handles and avoid interference between the user's hands thereon in the tube bending operation. The mandrel further defines an extension adapted for mounting thereof in a vise or the like. The handle connected to the mandrel is removably connected thereto as for removal when the mandrel is vise-mounted. The tube clamping structure includes a hook which is swingably mounted to the mandrel, and in the illustrated embodiment, is mounted between the mandrel and the mounting portion for mounting the mandrel handle and defining the vise-mounting structure.

28 Claims, 7 Drawing Figures

90
180
7.
V

TUBE BENDER CONSTRUCTION

BACKGROUND OF THE INVENTION

1. Field of the Invention

This invention relates to tube benders and in particular to manually operable tube benders wherein a forming member is swung about a bending axis by means of a handle associated therewith and a handle mounted to the mandrel.

2. Description of the Background Art

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. A second handle is connected to the mandrel. A hook is swingably mounted on the second handle for engaging the tube at a point adjacent the bend start point of a groove in the periphery of the mandrel into which the tube is urged in the bending operation.

Further improved tube benders are illustrated in U.S. Pat. Nos. 2,887,917 and 3,926,028 of the inventor herein. In U.S. Pat. No. 2,887,917, a tube bender is illustrated wherein the handle connected to the mandrel is provided with an offset and improved scale means are provided on the mandrel for indicating the extent of the formed bend.

In Kowal Pat. No. 3,926,028, the tube bender is provided with a vise mounting portion in lieu of the handle secured to the mandrel. In one form, the hook is formed integrally with the male clamp portion, and in a second form, the hook is pivotally mounted thereon.

In U.S. Pat. No. 3,750,447 of the inventor herein and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel.

SUMMARY OF THE INVENTION

The present invention comprehends an improved manually operable tube bender construction having improved handle means wherein the gripping portions of the handles associated with the forming member and mandrel, respectively, are arranged so as to effectively avoid formation of force couples tending to twist the tool during the bending operation. More specifically, the invention comprehends the provision of such a handle construction wherein the gripping portions are disposed at or adjacent a common plane defined by the plane of the root of the bending groove of the mandrel. At least one of the handles is provided with an angularly extending portion for permitting the other handle to pass through the aligned relationship of the gripping portions in effecting large angle bends.

The handle connected to the mandrel may be mounted thereto by means of a unitarily integral extension of the mandrel which further defines means for mounting of the tool in a vise or the like. The mounting structure defines a first portion forming a socket for receiving the end of the mandrel mounted handle and means may be provided for removably securing that handle thereto.

The vise mounting portion is preferably formed without openings or recesses therein so as to provide a strong support when clamped in a vise or the like.

The hook may be swingably mounted to the mandrel by a portion of the mounting means intermediate the portion defining the handle and vise mounting means.

In the illustrated embodiment, the mandrel further defines a unitarily integral extension forming a rectilinear extension of the bending groove extending away from the bend start point of the groove to adjacent the hook means. The hook is arranged to clamp the tube to the mandrel extension in the extension of the bending groove for improved retention of the tube against longitudinal movement during the bending operation.

The portion of the mandrel defining the groove extension may further comprise a portion of the mounting means so that the entire mandrel mounting means and tube clamp surface may comprise a one-piece integral element.

The hook in the illustrated embodiment is provided with an arcuate pressure-applying clamp surface for urging the tube against the extended tube support with a force resulting from the swinging of the hook.

In the illustrated embodiment, the handle construction more specifically includes a first handle connected to the forming member and having a distal end defining a first gripping portion at said bending plane, and a second handle having a connecting portion connected to the mandrel and extending therefrom away from the bending plane and defining a second gripping portion connected to the distal end of the connecting portion and extending therefrom toward the bending plane, the second griping portions being disposed at a distance from the bending axis a distance greater than the spacing of the first gripping portion therefrom, whereby the first gripping portion may be swung about the bending axis to adjacent the second gripping portion free of interference between the user's hands on the gripping portions.

In the illustrated embodiment, the tube support cooperating with the clamping hook is defined by a portion of the mandrel defining a rectilinear groove extending away from the bending groove at the bend start point to adjacent the means for holding the tube for receiving a portion of the tube to be bent, the means for holding the tube comprising means for clamping the tube portion to the groove defining means.

In the illustrated embodiment, the handle and vise mounting means is defined by means extending from the mandrel and defining first and second mounting portions, the first mounting portion being arranged to have the second handle connected thereto for use in effecting a tube bending operation as an incident of manipulation of the two handles, and the second mounting portion being arranged to be mounted in a vise for use in effecting tube bending operations as an incident of movement of the first handle while the mandrel is fixedly held by the vise.

Thus, the tube bender construction of the present invention is extremely simple and economical while yet providing the highly improved features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
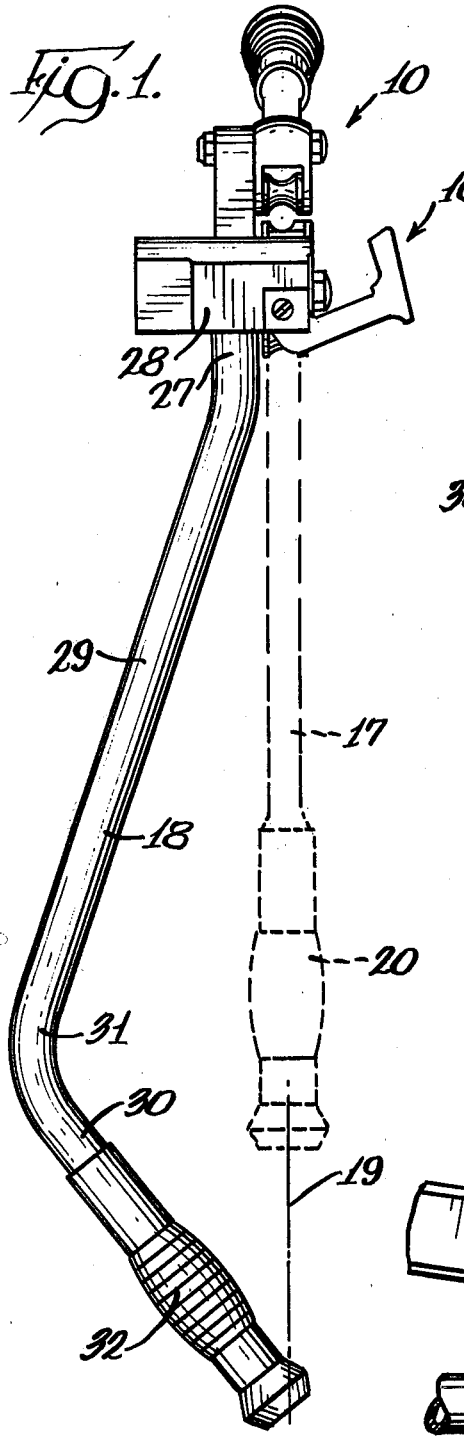
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a holding means generally designated 16.

Movement of the forming member 13 about axis 14 is effected by suitable manipulation of a pair of handles 17 and 18 connected respectively to the forming member 13 and mandrel 11.

Figure 2:
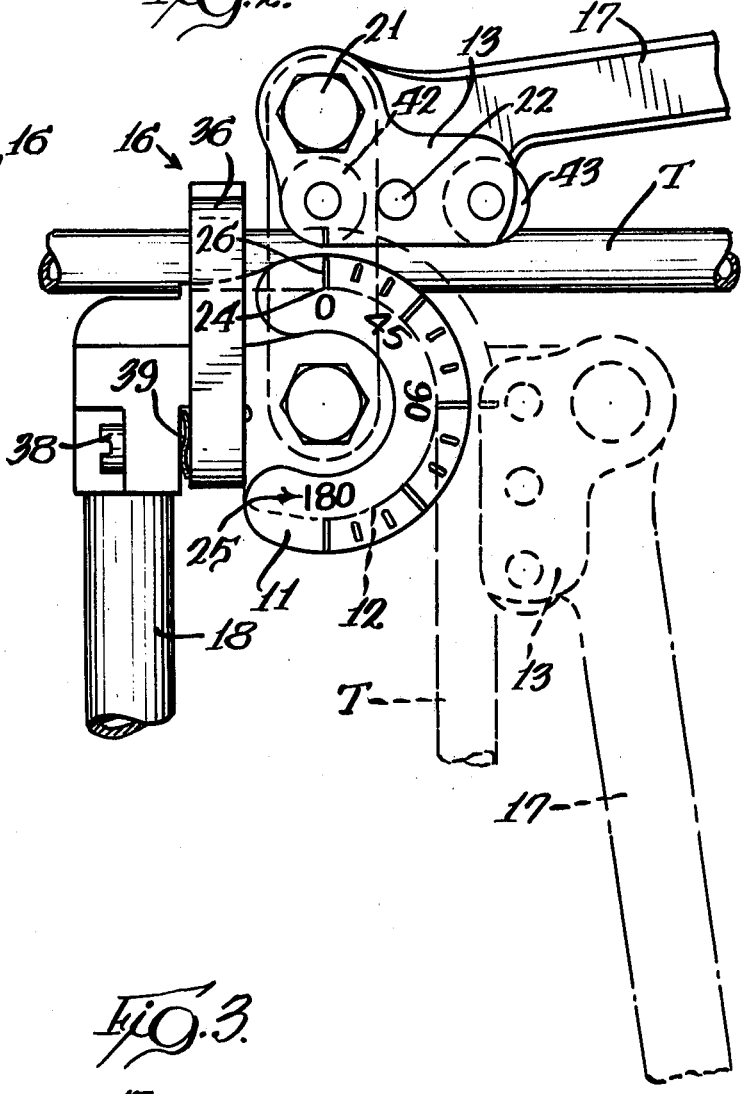
FIG. 2 is a fragmentary side elevation thereof with the forming member shown in a 90° bend position in broken lines.
Figure 3:
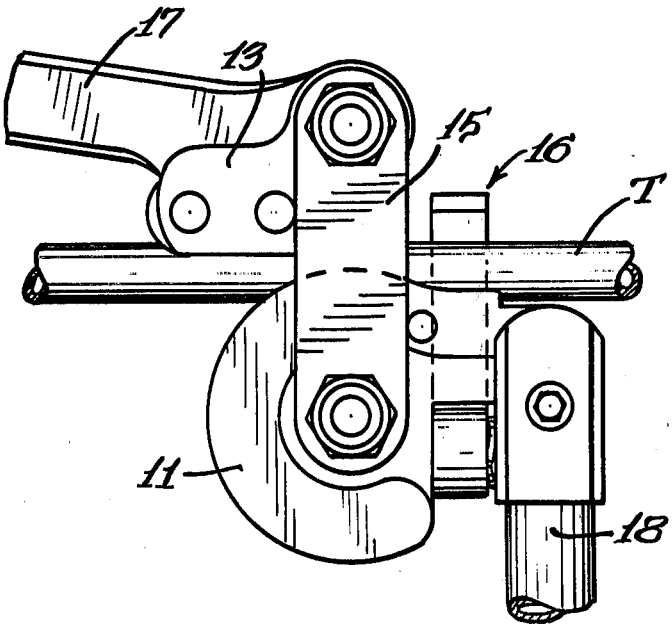
FIG. 3 is a fragmentary rear elevation thereof.
Figures 4, 5, 6, 7:
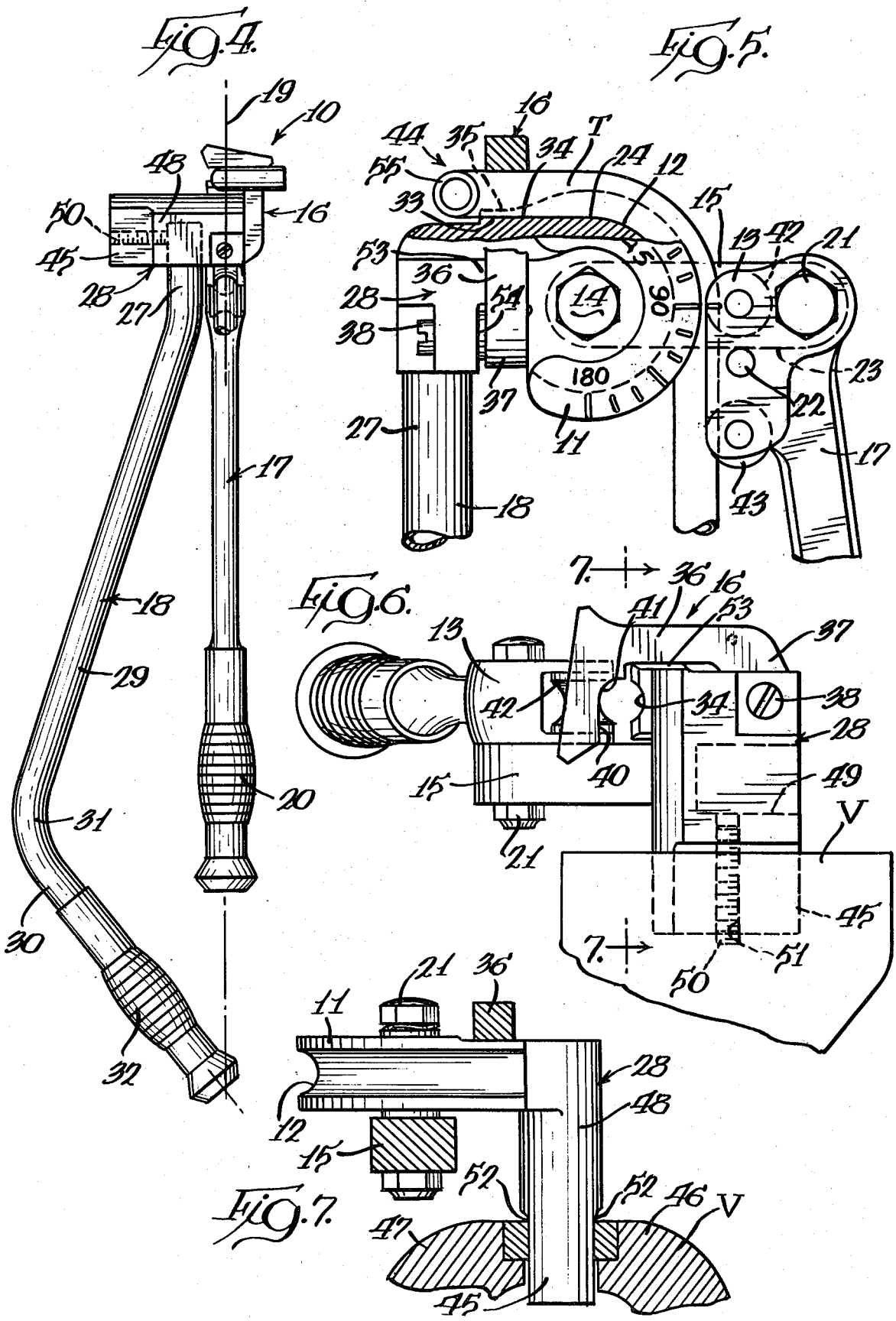
FIG. 4 is an elevation similar to that of FIG. 1 but illustrating the arrangement of the tube bender when arranged for manually bending a tube held in the hook thereof.
FIG. 5 is a fragmentary elevation with portions broken away for illustrating in greater detail the tube support portion of the tube clamping means.
FIG. 6 is an elevation illustrating the mounting of the tube bender in a vise.
FIG. 7 is a fragmentary vertical section taken substantially along the line 7—7 of FIG. 6.

The invention comprehends a novel arrangement of handles 17 and 18 to permit facilitated bend formation. More specifically, as illustrated in FIG. 4, the root of the mandrel bending groove 12 defines a plane 19. Handle 17 defines at its distal end a gripping portion 20 which, as shown in FIG. 4, is disposed at the bending plane 19. In the illustrated embodiment, handle 17 is connected to the link 15 by a pivot connection 21, which is limited in the clockwise direction of movement by the engagement of a pin 22 on the forming member engaging an edge surface 23 of the link. However, handle 17 and forming member 13 connected thereto may be swung in a counterclockwise direction from the position shown in full lines in FIG. 2 to permit facilitated insertion of the tube T into the bending groove 12 to extend perpendicularly tangentially to the bending groove at a bend start point 24 thereof. As shown in FIG. 2, the mandrel may be provided with a scale 25 having a zero indicator 26 at the bend start point 24 and other angular indications spaced correspondingly therefrom.

Handle 18, as seen in FIG. 1, includes a connecting portion 27 connected to the mandrel by means of an integral unitary extension 28 of the mandrel defining a mounting means. As further shown in FIG. 1, the handle includes a first portion 29 extending angularly from connecting portion 27, and a second angularly extending portion 30 extending from the distal end 31 of the handle portion 18 angularly back toward the bending plane 19.

In the illustrated embodiment, handle portion 30 defines a gripping portion 32 which extends to at least adjacent bending plane 19 so that the two gripping portions 20 and 32 are effectively located in a common plane of the bending operation so as to effectively avoid force couples tending to twist the tool during the manual bending operation.

Further, as seen in FIG. 4, the provision of the angularly extending portions 18 and 30 with the portion of maximum spacing 31 located generally in alignment with gripping portion 20 of handle 17 permits the gripping portion to cross over handle 18 in making large bends such as bends beyond the 90° position shown in FIG. 5.

As will be obvious to those skilled in the art, the location of the gripping portions 20 and 32 may be more or less radially related to the bend axis 14 and relative to the bending plane 19, as desired. Further, the amount of offset of handle 18 may be suitably selected to provide desired clearance of the user's hand on gripping portion 20 relative to handle 18 in the crossover position.

In the illustrated embodiment, handle 17 extends substantially rectilinearly, it being obvious to those skilled in the art that other suitable configurations may be utilized for handle 17 as desired. Similarly, the handle portions 29 and 30 of handle 18 extend substantially rectilinearly in the illustrated embodiment, it being obvious to those skilled in the art that the handle 18 may comprise an arcuate arrangement if so desired.

The invention further comprehends improved means for holding tube T against longitudinal displacement during the tube bending operation effected by the manipulation of handles 17 and 18, as discussed above. As best seen in FIG. 5, mandrel 11 defines an integral extension 33 which further defines an integral extension 34 of the bending groove 12 of the mandrel. As seen in FIG. 5, bending groove extension 34 extends from the bend start point 24 rectilinearly to adjacent the holding means 16 and, thus, defines means for receiving the rectilinear tube T to be bent and holding the tube in position for coaction with the holding means 16. While the groove extension extends rectilinearly, the depth thereof may decrease outwardly toward holding means 16, as illustrated in FIG. 5 by the dotted line illustration of the top 35 of the edges of the groove defined by the mandrel extension portion 33.

In the illustrated embodiment, the tube holding means 16 effectively defines a clamp for clamping the tube T to the mandrel extension 33 in the groove portion 34. More specifically, as seen in FIG. 6, holding means 16 is defined by a hook 36 having a connecting portion 37 pivotally mounted to mandrel 11 by a pivot pin 38. A spring washer 39 may be provided for providing frictional retention of the hook against free swinging on the pivot pin.

As seen in FIG. 6, hook 36 defines a clamping, pressure-applying surface 40 which is disposed to engage the tube T when disposed in the bending groove extension 34. As seen in FIG. 6, clamping surface 40 extends at an angle so as to define a wedge surface progressively clamping the tube T with increased force as a result of counterclockwise swinging of the hook 36, as seen in FIG. 6. Surface 40 may include an arcuate end portion 41 limiting the pivotal movement of the hook relative to the tube.

As further seen in FIG. 6, the forming member 13 includes a forming roller 42 which cooperates with a second roller 43, as shown in FIG. 5, in effecting the desired bending of the tube T as the forming member 13 is swung around the mandrel as between the full line position of FIG. 2 and the dotted line 90° position therein. Thus, the clamping action of the hook urging the hook forcibly into clamped seated engagement in the bending groove extension 34 effectively locks the tube T against longitudinal displacement as the forming member 13 is moved thereabout.

Referring to FIG. 5, the space 44 outwardly of the hook at the end of groove extension 34 is open so as to accommodate previously bent portions of the tube, such as bent portion 55, thereby permitting formation of multiple bends in the tube T with improved facility.

Thus, the invention comprehends the provision of clamping means for holding the tube to be bent. The provision of a wedging surface on the hook permits the hook to urge the tube forcibly against a support defined by the extension of the mandrel from the bend start point to provide improved facilitated installation and securing of the tube against longitudinal movement in the bending tool. In one aspect, the tube holding means comprises fixed means carried by the mandrel for supporting the tube and movable means carried by the mandrel for clamping the tube against the support means.

As indicated briefly above, the invention further comprehends the provision of means for providing facilitated mounting of the tube bending tool to a clamping device, such as a vise V, as shown in FIG. 6, when desired. More specifically, the mounting extension 28 of the mandrel defines a distal block portion 45 which is adapted to be clamped between the jaws 46 and 47 of the vise, as illustrated in FIG. 7. As shown in FIG. 4, the mounting portion 28 includes a handle mounting portion 48 defining a socket 49 for receiving the connecting portion 27 of handle 18. A suitable set screw 50 may be provided in a suitable threaded bore 51 in the mounting portion 28 for releasably locking the handle portion 27 in the socket. Thus, handle 18 may be readily removed from the bending tool when it is desired to mount the bending tool in the vise V, as illustrated in FIGS. 6 and 7.

The mounting block portion 45 provides a strong, effectively unconstrictible portion of the mandrel supporting means accommodating the substantial forces which may be generated by the clamping of the vise jaws 46 and 47 thereagainst.

As further illustrated in FIGS. 6 and 7, the mounting portion 28 may define a pair of shoulders 52 effectively indicating the disposition of the second portion for facilitated installation of the mounting portion 28 in the vise, as illustrated in FIG. 7. By limiting the insertion of the mounting portion to the mounting block portion 45 thereof, distortion of the handle mounting portion 48, including the socket 49 and bore 51 is effectively precluded, thereby providing improved long troublefree life of the tube bending tool.

Thus, the invention comprehends the provision of a vise mounting portion integral with the mandrel. The arrangement of the vise mounting portion permits forming the bends on the clamping side of the tool, thereby eliminating interference with the handle 18, which, as discussed above, may be removed if desired where the tool is installed in a vise, as shown in FIGS. 6 and 7.

In the illustrated embodiment, as shown in FIG. 5, the mounting portion 28 is unitarily and integrally joined to mandrel 11 by a connecting portion 53 which defines a recess 54 in which the connecting portion 37 of the hook is received. As shown in FIG. 6, clockwise swinging of the hook is limited by the engagement of the hook 36 with portion 53.

In use, the operator installs the tube T in the tube bender, as illustrated in FIG. 2, with the tube extending tangentially to the bending groove 12 at the bend start point 24. The hook 36 is swung into engagement with the tube to clamp the tube against extension portion 33 to lock the tube against longitudinal movement during the bending operation. During the installation of the tube, handle 17 is swung in a counterclockwise direction from the position of FIG. 2 to space the forming means 13 from the mandrel, permitting facilitated installation of the tube T. The handle 17 is then swung in a clockwise direction to the full line position of FIG. 2. Suitable manipulation of handles 17 and 18 is then effected to move the forming means 13 circumferentially about the mandrel to effect a bending of the tube into the groove 12 to the desired angular extent.

Illustratively, as shown in broken lines in FIG. 2, the forming member may be swung approximately 90 degrees from the full line position thereof to effect a 90° bend in the tube T.

If it is desired to provide a bend of greater extent, such as a 180° bend, continued clockwise movement of handle 17 may be effected to cause a crossover between gripping portions 20 and 32 permitted by the substantial clearance of handle portion 31 from gripping portion 20. As further indicated above, the disposition of the gripping portions 20 and 32 substantially at the bending plane 19 eliminates the formation of force couples during the bending operation, providing further facilitated bending of the tube.

The use of the extended tube support groove 34 further assures accurate alignment of the axis of the tube with said bending groove plane 19 at all times.

The foregoing disclosure of specific embodiments is illustrative of the broad inventive concepts comprehended by the invention.

I claim:

1. In a manually operable tube bender having a mandrel defining a tube-receiving bending groove extending arcuately about a bend axis to define a bending plane, a forming member mounted to said mandrel to swing about said bend axis for urging a tube to be bent into said bending groove, and means for holding the tube against longitudinal displacement in said bending groove during a tube bending operation, the improvement comprising:

a first handle connected to the forming member and having a distal end defining a first gripping portion at said bending plane; and a second handle having a connecting portion connected to the mandrel and extending therefrom away from the bending plane and defining a second gripping portion connected to the distal end of the connecting portion and extending therefrom toward the bending plane, said second gripping portion being disposed at a distance from said bending axis a distance greater than the spacing of said first gripping portion therefrom, whereby said first gripping portion may be swung about said bending axis to adjacent said second gripping portion free of interference between the user's hands on said gripping portions at said bending plane.

2. The manually operable tube bender of claim 1 wherein said first handle extends substantially rectilinearly.

3. The manually operable tube bender of claim 1 wherein said first handle extends substantially rectilinearly in alignment with said bending plane.

4. The manually operable tube bender of claim 1 wherein said second handle connecting portion extends substantially rectilinearly angularly away from said bending plane.

5. The manually operable tube bender of claim 1 wherein said second handle gripping portion extends substantially rectilinearly angularly toward said bending plane.

6. The manually operable tube bender of claim 1 wherein said second handle connecting portion extends substantially rectilinearly angularly away from said bending plane and said second handle gripping portion extends substantially rectilinearly angularly toward said bending plane, said distal end of said second handle connecting portion being spaced from said bending axis a distance substantially equal to the spacing of said first gripping portion therefrom to provide therebetween effectively maximum clearance between said handles.

7. In a manually operable tube bender having a mandrel defining a tube-receiving bending groove extending arcuately about a bend axis to define a bending plane, a forming member mounted to said mandrel to swing about said bend axis for urging a tube to be bent into said bending groove, and means for holding the tube against longitudinal displacement in said bending groove during a tube bending operation, the improvement comprising:

a first handle connected to the forming member and having a distal end defining a first gripping portion at said bending plane; and a second handle having a connecting portion connected to the mandrel and extending therefrom away from the bending plane and defining a second gripping portion connected to the distal end of the connecting portion and extending therefrom toward the bending plane, said second gripping portion being disposed at a distance from said bending axis a distance greater than the spacing of said first gripping portion therefrom, whereby said first gripping portion may be swung about said bending axis to adjacent said second gripping portion free of interference between the user's hands on said gripping portions, said second gripping portion extending to said bending plane to be disposed radially outwardly of said first gripping portion when said gripping portions are most closely juxtaposed.

8. The manually operable tube bender of claim 1 wherein said second handle connecting portion is connected to the mandrel at a position spaced from said bending plane.

9. The manually operable tube bender of claim 1 wherein said second handle gripping portion extends adjacent said bending plane.

10. In a manually operable tube bender having a mandrel defining a tube-receiving bending groove having a substantially constant depth extending arcuately about a bend axis, a forming member mounted to said mandrel to swing about said bend axis for urging a tube to be bent into said bending groove, and tube holding means for holding the tube against longitudinal displacement in said bending groove during a tube bending operation with the tube extending rectilinearly perpendicularly to a radius from the bending axis at a bend start point of the bending groove, the improvement comprising:

means integral with said mandrel defining a rectilinear tube positioning groove extending away from said bending groove at said bend start point to a position opposed to said tube holding means for receiving a portion of the tube to be bent, said positioning groove decreasing in depth away from said bend start point, said tube holding means comprising means for clamping said tube portion to said positioning groove at said opposed position, the portion of said groove at said opposed position comprising a portion of said groove of substantially minimum depth to effectively preclude bending of the clamped tube in said groove portion, said groove portion being free of extension substantially beyond said position to permit a previously formed bend to be disposed closely adjacent said position.

11. The manually operable tube bender of claim 10 wherein said tube holding means is pivotally mounted to said means defining the rectilinear groove integral with the mandrel.

12. The manually operable tube bender of claim 10 wherein said rectilinear groove extends perpendicularly to said radius at the bend start point.

13. The manually operative tube bender of claim 10 wherein said tube holding means comprises means pivotally mounted to the mandrel adjacent said bend start point for wedgingly clamping the rectilinearly extending tube to the mandrel.

14. The manually operable tube bender of claim 10 wherein said tube holding means comprises support means fixedly associated with the mandrel and pressure-applying means movably associated with the mandrel.

15. The manually operable tube bender of claim 10 wherein said tube holding means comprises support means fixedly associated with the mandrel and pressure-applying means swingably connected to the mandrel.

16. The manually operable tube bender of claim 10 wherein said tube holding means comprises arcuate support means fixedly associated with the mandrel and pressure-applying means movably associated with the mandrel.

17. The manually operable tube bender of claim 10 wherein said tube holding means comprises a hook swingably connected to the mandrel and defining a pressure-applying wedge surface engaging the rectilinearly extending tube portion, said wedge surface being arranged to provide increasingly greater clamping force against said tube as an incident of swinging of the hook.

18. The manually operable tube bender of claim 10 wherein said tube holding means comprises a hook swingably connected to the mandrel and defining a pressure-applying wedge surface engaging the rectilinearly extending tube portion, said wedge surface being arranged to provide increasingly greater clamping force against said tube as an incident of swinging of the hook and an arcuate stop surface for abutment with the tube for limiting the swinging of the hook to a maximum pressure-applying position.

19. In a manually operable tube bender having a mandrel defining a tube-receiving bending groove extending arcuately about a bend axis to define a bending plane, a forming member mounted to said mandrel to swing about said bend axis for urging a tube to be bent into said bending groove, and means for holding the tube against longitudinal displacement in said bending groove during a tube bending operation, the improvement comprising:

a first handle connected to the forming member;

a second handle; and mounting means extending from said mandrel and defining first and second mounting portions, said first mounting portion being arranged to have said second handle connected thereto and extending normally to the direction of the tube at the holding means for use in effecting a tube bending operation as an incident of manipulation of the two handles, and said second mounting portion defining means arranged to be mounted in a vise for use in selectively effecting tube bending operations (a) as an incident of movement of said first handle while said second mounting portion is fixedly held by a vise, (b) as a result of movement of said handles with said second mounting portion free of support, and (c) as an incident of relative movement between said handles while the second mounting portion is fixedly held by a vise.

20. The manually operable tube bender of claim 19 wherein said mounting means comprises an integral extension of said mandrel.

21. The manually operable tube bender of claim 19 wherein said mounting means defines means for indicating the disposition of said second portion.

22. The manually operable tube bender of claim 19 wherein said mounting means defines a shoulder between said first and second portions for indicating the disposition of said second portion.

23. The manually operable tube bender of claim 19 wherein said first portion defines a recess for receiving one end of said second handle, and means are provided for releasably locking said end therein.

24. The manually operable tube bender of claim 22 wherein said second portion comprises a block portion provided with a set screw for removably securing the second handle to said mounting means.

25. The manually operable tube bender of claim 19 wherein said holding means comprises a hook, and said mounting means further defines means for swingably mounting said hook.

26. The manually operable tube bender of claim 19 wherein said holding means comprises a hook, and said mounting means further defines a third portion contiguous with said mandrel for swingably mounting said hook.

27. The manually operable tube bender of claim 19 wherein said mandrel groove defines a bend start point and said mounting means further defines a rectilinear groove extending away from said bending groove at said bend start point to adjacent said means for holding the tube for receiving a portion of the tube to be bent, said means for holding the tube comprising means for clamping said tube portion to said groove defining means.

28. In a manually operable tube bender having a mandrel defining a tube-receiving bending groove extending arcuately about a bend axis to define a bending plane, a forming member mounted to said mandrel to swing about said bend axis for urging a tube to be bent into said bending groove, and means for holding the tube against longitudinal displacement in said bending groove during a tube bending operation, the improvement comprising:

a first handle connected to the forming member;

a second handle having a length at least a major portion of the length of said first handle; and mounting means extending from said mandrel and defining first and second mounting portions, said first mounting portion being arranged to have said second handle connected thereto for use in effecting a tube bending operation as an incident of manipulation of the two handles, and said second mounting portion defining means arranged to be mounted in a vise for use in effecting tube bending operations as an incident of movement of said first handle while the mandrel is fixedly held by the vise, said first handle having a distal end defining a first gripping portion at said bending plane, and said second handle having a connecting portion connected to said first mounting portion and extending therefrom away from the bending plane, and defining a second gripping portion connected to the distal end of the connecting portion and extending therefrom toward the bending plane, said second gripping portion being disposed at a distance from said bending axis a distance greater than the spacing of said first gripping portion therefrom, whereby said first gripping portion may be swung about said bending axis to adjacent said second gripping portion free of interference between the user's hands on said gripping portions.

* * * * *

UNITED STATES PATENT AND TRADEMARK OFFICE

CERTIFICATE OF CORRECTION

PATENT NO. : 4,403,496

DATED : September 13, 1983

INVENTOR(S) : Leonard J. Kowal

It is certified that error appears in the above-identified patent and that said Letters Patent is hereby corrected as shown below:

Column 9, line 30 (Claim 24, line 1), after "claim" cancel "22" and substitute therefor --19--.

Signed and Sealed this

Sixth Day of December 1983

[SEAL]

*Attest:*

GERALD J. MOSSINGHOFF

*Attesting Officer*

*Commissioner of Patents and Trademarks*